US005255301A

United States Patent [19]

Nakamura et al.

[11] Patent Number: 5,255,301

[45] Date of Patent: Oct. 19, 1993

[54] APPARATUS FOR COUNTING THE NUMBER OF PASSING PERSONS BY STATURE

[75] Inventors: Kiyohisa Nakamura; Kanji Matsuhashi, both of Hiroshima, Japan

[73] Assignee: Shinkawa Electric Co., Ltd., Hiroshima, Japan

[21] Appl. No.: 785,066

[22] Filed: Oct. 30, 1991

[30] Foreign Application Priority Data

Nov. 6, 1990 [JP] Japan ..... 2-300877

[51] Int. Cl.[5] ..... G07C 9/00; G06M 1/00

[52] U.S. Cl. ..... 377/6; 377/53; 250/221; 340/556

[58] Field of Search ..... 377/6, 53; 340/556; 250/221

[56] References Cited

U.S. PATENT DOCUMENTS 4,278,878 7/1981 Kato ..... 377/6
4,356,387 10/1982 Tsubota et al. ..... 377/6
4,384,195 5/1983 Nosler ..... 377/53
4,628,520 12/1986 Menger ..... 377/6
4,847,485 7/1989 Koelsch ..... 377/6
4,993,049 2/1991 Cupps ..... 377/6
5,138,638 8/1992 Frey ..... 377/6

FOREIGN PATENT DOCUMENTS 54-65075 5/1979 Japan .
55-16278 2/1980 Japan .

*Primary Examiner*—John S. Heyman
*Attorney, Agent, or Firm*—Sandler Greenblum & Bernstein

[57] ABSTRACT

An apparatus for counting the number of passing persons by stature, wherein a projector for radiating light toward the head of a passing person, a light receiving lens for receiving light reflected from the person's head, and a light position detector are arranged as one set at an upper portion of a gateway or a passageway. The light receiving lens converges reflected light to different light-received positions of the light position detector according to the height of the reflective position. The light position detector outputs electric signals which differ according to the reflected light received at the light-received positions and a counting operation is performed discriminatively for every output of the signals.

8 Claims, 3 Drawing Sheets

APPARATUS FOR COUNTING THE NUMBER OF PASSING PERSONS BY STATURE

BACKGROUND OF THE INVENTION

1. Field of the Invention

The present invention relates to a method for counting the number of passing persons by stature and more particularly to a method for counting the number of persons by stature who are passing through a gateway or a passage in a building such as a department store or an exhibition building.

2. Description of the Prior Art

Heretofore, there has been known a method for counting the number of passing persons wherein a projector and a receptor are disposed at an upper portion of a gateway or a passage. According to this method, when a person has arrived at a crossing portion of a light beam emitted from the projector and an extension of a light incoming path in the receptor, there is formed a light loop between the projector and the receptor. This light loop is then taken out as a signal and, thereafter, a counting operation is performed (as disclosed in Japanese Patent Laid-Open Nos. 65075/79 and 16278/80).

According to the above conventional method, it is possible to discriminate whether the stature of the passing person is large or small, that is, whether the passing person is an adult or a child, or whether baggage is passing through the gateway or passage, on the basis of the height of the loop formed. However, one set of the projector and the receptor merely permits the discrimination of the height, and it is impossible to discriminate plural heights, or count the number of passing persons by stature.

For the discrimination of plural heights in the conventional method it is necessary to provide several projectors according to the number of heights to be discriminated, resulting in that the mounting space becomes larger and a signal control means becomes complicated and expensive inevitably. Furthermore, for every change in position of the projector and the receptor it is required to manually adjust the respective positions. Since this adjustment is performed in high positions, not only the working efficiency is poor but also it is dangerous.

SUMMARY OF THE INVENTION

It is the object of the present invention to eliminate the above-mentioned drawbacks of the prior art and provide a simple means capable of efficiently counting the number of passing persons by stature.

The counting method of the present invention, according to a first embodiment thereof, is characterized in that a projector for radiating light toward the head of a passing person, a light receiving lens for receiving light reflected from the person's head, and a light position detector are arranged as a set at an upper portion of a gateway or a passage. The light receiving lens converges reflected light to different light-receiving positions of the light position detector according to the height of the reflective positions. The light position detector outputs electric signals which differ according to the reflected light received at the light-received positions and a counting operation is performed discriminatively at every output of the signal.

In a second embodiment, the counting method of the present invention is characterized in that the output signals from the light position detector are each discriminated by a discrimination device consisting of a comparator and a setting unit capable of setting a threshold value. In a third embodiment, the counting method of the present invention is characterized in that plural sets consisting of the projector, light receiving lens and light position detector are arranged side by side in the width direction of the gateway or the passage.

Further, according to a fourth embodiment, the counting method of the present invention is characterized in that two sets consisting of the projector, light receiving lens and light position detector are arranged in spaced relation to each other along the passing direction of the gateway or the passage, and whether each person is entering or leaving is discriminated on the basis of a light reception sequence of the light position detectors in both sets.

According to the first embodiment of the present invention, light emitted from the projector is reflected by the head or a shoulder portion of a passing person and the reflected light is received by the light position detector through the light receiving lens (the resolving power for the stature corresponds to the head length). In this case, the reflected light is focused at a specific position of the light position detector corresponding to the height of the reflective position, that is, the stature of the passing person, and an electric signal is outputted. Therefore, statures of passing persons are classified by discriminating such output signals and the number of passing persons by stature is determined by counting such output signals.

According to the second embodiment of the present invention, each output signal from the light position detector is compared with an input value (threshold value) preset in the setting unit and thereby discriminated. The input value can be set and changed at a remote place.

According to the third embodiment of the present invention, even when plural persons pass side by side simultaneously, the passing persons are counted discriminately for for each set, thereby counting the number of passing persons by stature. Further, according to the fourth embodiment of the present invention, when the light position detector in a rear row (as seen from the exterior of the gateway or the passage) first receives light and thereafter the light position detector in a front row receives light, this passing person is judged to be a visitor, while when the front and rear light position detectors receive light in this order, it is judged that the passing person is leaving the gateway or the passage, and counting is made.

DESCRIPTION OF PREFERRED EMBODIMENTS

Embodiments of the present invention will be described in detail hereinunder with reference to the drawings.

Figure 1:
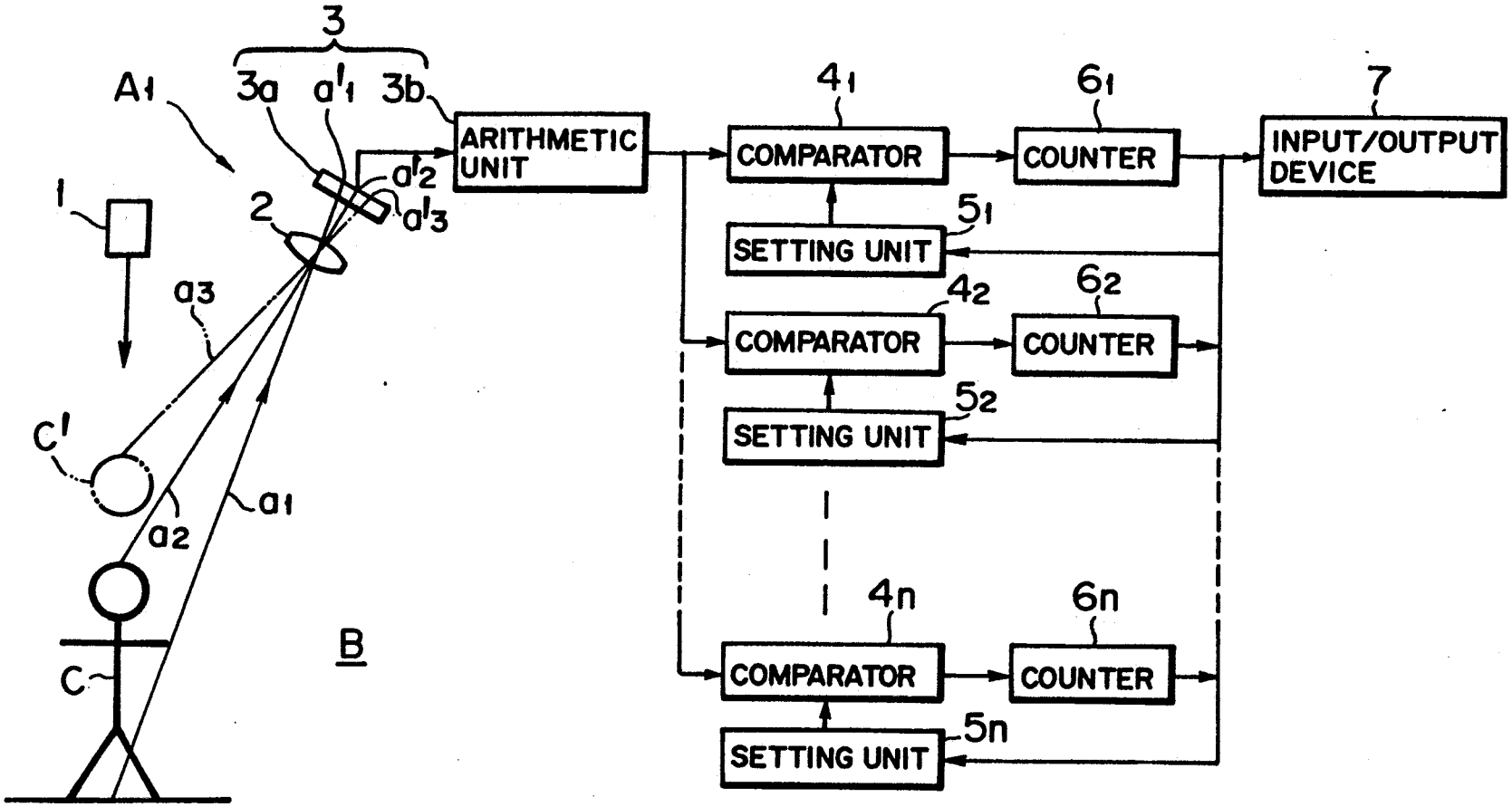
FIG. 1 is a block diagram showing fundamental operations of the counting method according to a first embodiment of the present invention.

In FIG. 1, which is a block diagram showing the fundamental operations of the present invention, a projector 1, a light receiving lens 2, and a position detector 3 are provided as members of one set constituting a detecting portion $A_1$.

The detecting portion $A_1$ is disposed in an upper position of a gateway or passage B, for example on the ceiling wall, by hanging, direct fixing, or embedding.

The projector 1 comprises a light emitting element capable of emitting an infrared ray or visible or invisible light from an upper to lower portion vertically or at a suitable angle so that the light is directed to the head of a person C passing through the gateway or passage B.

The light receiving lens 2 converges light which has been reflected by the head of the passing person C after emission from the projector 1, and is disposed near the light position detector 3.

The light position detector 3 comprises a light position detecting element 3*a*, such as a PSD element or a phototransistor, and an arithmetic unit 3*b*. In this embodiment, a PSD element is used as the light position detecting element 3*a* and is disposed on an optical axis of the light receiving lens 2 at a predetermined spacing from the lens.

The light position detecting element 3*a* outputs signals which differ according to light-radiated positions, namely, signals proportional to light-received positions. Those signals are subjected to arithmetic processing, including addition, subtraction and division, in the arithmetic unit 3*b*, which in turn outputs continuous electric signals corresponding to light-received positions.

The present invention intends to discriminate statures by utilizing the aforementioned characteristic of the light position detecting element 3*a* and the fact that the height of light reflected position differs depending on the stature of the passing person C.

More specifically, as shown in FIG. 1, when there is no passing person, light emitted from projector 1 is reflected as reflected light $a_1$ from the floor surface and the reflected light $a_1$ is received at position $a_1'$ of the light position detecting element 3*a* through the light receiving lens 2. On the other hand, when there is a passing person C on the radiated light ray, reflected light $a_2$ from the head or a shoulder portion of the passing person is received at position $a_2'$ of the light position detecting element 3*a* through the light receiving lens 2. In the case of a passing person C of a higher stature, reflected light $a_3$ is received in position $a_3'$ of the detecting element 3*a*.

In order to count the number of persons by stature, the light position detector 3 outputs electric signals proportional to the reflected light-received at light-received positions $a_1'$, $a_2'$, $a_3'$, . . . of the detecting element 3*a* that are counted discriminatively.

In the illustrated embodiment, as a discriminating and counting device there is provided comparators $4_1$, $4_2$, $4_n$, setting units $5_1$, $5_2$, . . . $5_n$ and counters $6_1$, $6_2$, . . . $6n$. Each such comparator, setting unit and counter are combined as a $4_1$, $5_1$ and $6_1$, . . . $4_n$, $5_n$ and $6_n$, and such sets are provided by a number corresponding to statures (e.g. 150 cm, 160 cm, 170 cm, 180cm) to be discriminated.

Threshold values corresponding to statures are set beforehand in the setting units $5_1$, $5_2$, . . . $5_n$ by means of an input/output device 7. The threshold values and the foregoing output signals provided from the light position detector 3 are compared in the comparators $4_1$, $4_2$, . . . $4_n$, and any one of the counters $6_1$, $6_2$, . . . $6_n$ in the set including coincidence of the two is counted up, whereby the number of persons by stature is counted.

The comparators $4_1$, $4_2$, . . . $4_n$, setting units $5_1$, $5_2$, . . . $5_n$ counters $6_1$, $6_2$, . . . $6_n$ and input/output device 7 are connected through an external bus to a central processing unit (CPU) which constitutes a microcomputer, and their operations are controlled thereby. If necessary, there may be additionally used a date and time inputting device, a printing device, a display device or a device for communication to POS.

It is assumed that the value set in each of the setting units $5_1$, $5_2$, . . . $5_n$ can be varied by the input/output device 7.

Figure 2:
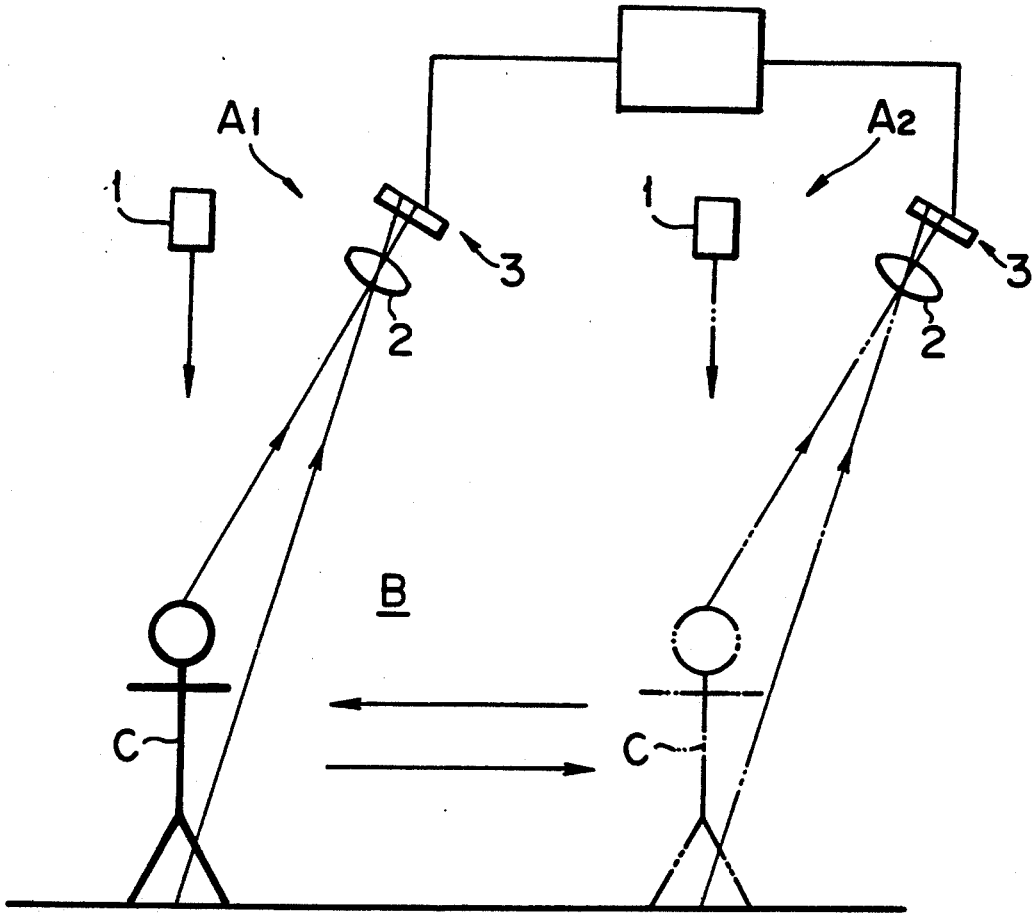
FIG. 2 is an arrangement diagram, according to a fourth embodiment the present invention, of two sets of detecting portions for counting the number of entering and leaving persons.

FIG. 2 shows an example in which two sets of detecting portions $A_1$ and $A_2$, each consisting of the projector 1, light receiving lens 2 and light position detector 3 are arranged in spaced relation to each other along the passing direction. of the gateway or passage B.

Figure 3:
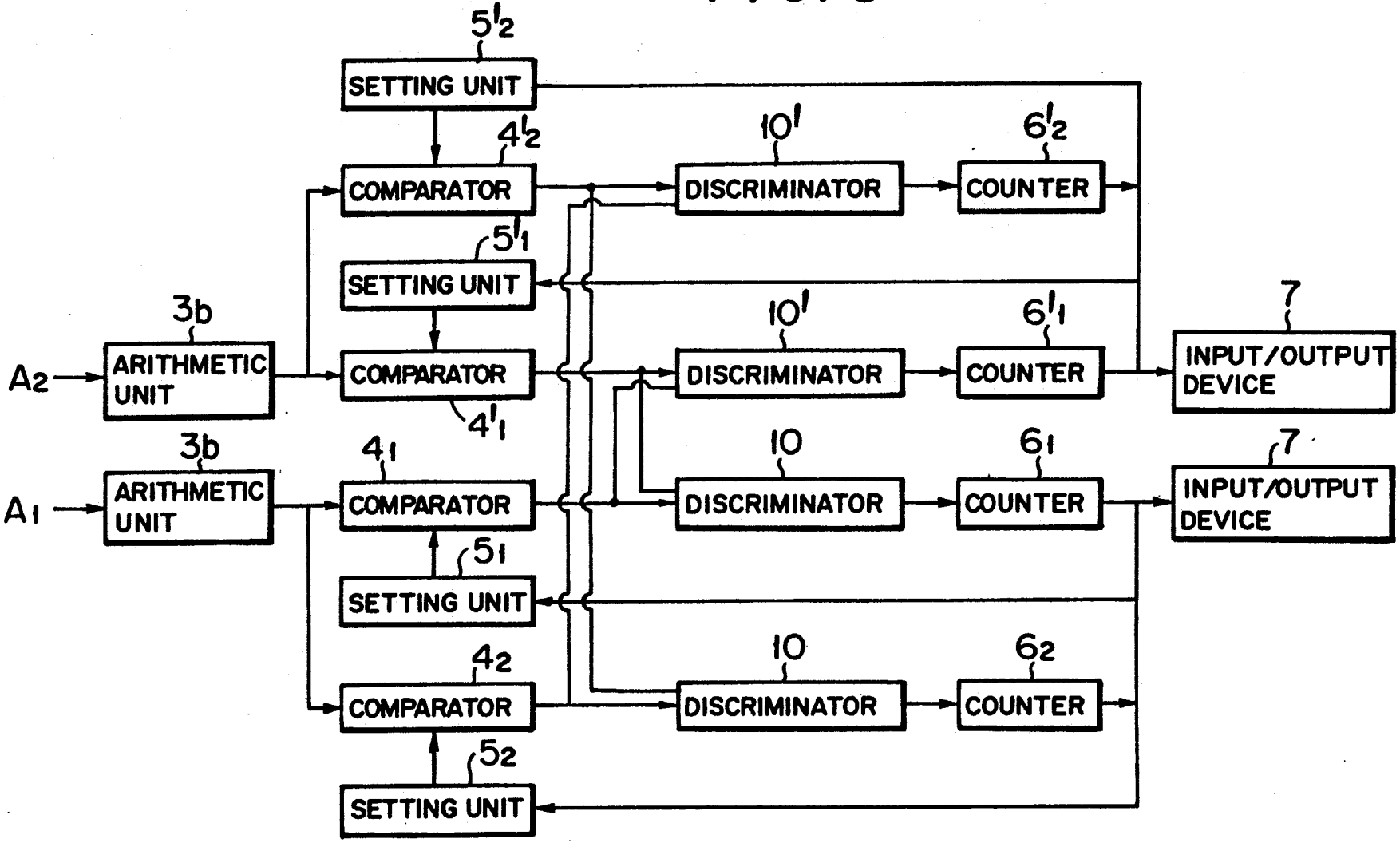
FIG. 3 is a block diagram of the discriminator device connected to the detecting portions shown in FIG. 2, according to a second embodiment of the present invention.

The operations of the detecting portions $A_1$ and $A_2$ are the same as in the previous case of using a single detecting portion in FIG. 1, but sequence discriminators 10 and 10' are interposed between the comparators $4_1$, $4_2$, . . . $4_n$, $4_1'$, $4_2'$, . . . $4_n$ and the counters $6_1$, $6_2$, . . . $6_n$ $6_1'$, $6_2'$, . . . $6_n'$ as a discriminating and counting device, and both discriminators 10 and 10' are connected together to detect a detecting operation, sequence of both detecting portions $A_1$ and $A_2$ (see FIG. 3).

The discriminators 10 and 10' receive both count signals from the comparators $4_1$, $4_2$, . . . $4_n$ on the detecting portion $A_1$ side and count signals from the comparators $4_1'$, $4_2'$, . . . $4_n'$ on the detecting portion $A_2$ side. The discriminator 10 first receives a count signals on the detecting portion $A_1$ side and, upon subsequent receipt of a count signal on the detecting portion $A_2$ side, it determines whether the passing person C is incoming, and causes any one of the counters $6_1$, $6_2$, . . . $6_n$ to count up.

On the other hand, the discriminator 10' first receives a count signal on the detecting portion $A_2$ side, and upon subsequent receipt of a count signal on the detecting portion $A_1$ side, it determines whether the passing person is leaving, and causes any one of the counters $6_1'$, $6_2'$, . . . $6_n'$ to count up.

Thus, the detecting portions $A_1$ and $A_2$ operate to count incoming and leaving persons, respectively.

Figure 4:
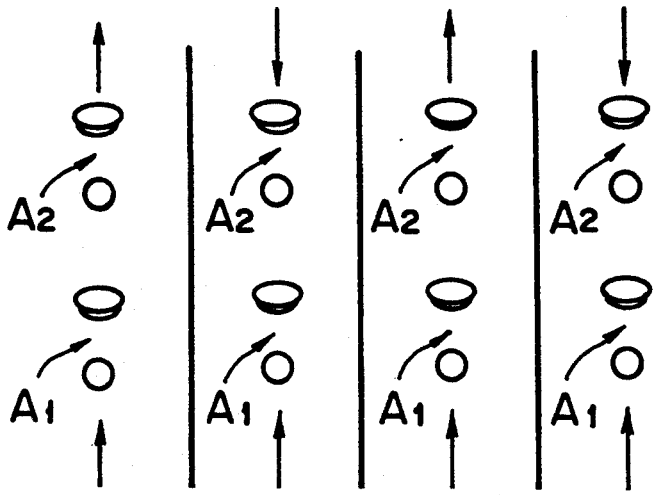
FIG. 4 is a plan view showing a mode of arrangement of plural sets of detecting portions, according to a third embodiment of the present invention.

FIG. 4 shows an example in which plural detecting portions $A_1$ and $A_2$ are arranged side by side along the width direction of the gateway or passage B. The spacing between adjacent detecting portions $A_1$, $A_1$, or $A_2$, $A_2$ is set on the basis of a passing width of one passing person.

Since the detecting portions $A_1$ and $A_2$ are arranged side by side like above, even when plural persons are incoming or leaving simultaneously in parallel, the number of incoming or leaving persons can be counted for each stature by the detecting portions $A_1$ and $A_2$.

According to the present invention, the number of passing persons can be counted at desired plural stages of stature by a set projector, light receiving lens and light position detector. Furthermore, since the input value each setting unit for setting a threshold value for each stature is made variable, the stature range to be counted can be changed without angular adjustment for the projector, etc. Thus, the counting method of the present invention is superior in operability and can enhance safety.

Moreover, by arranging plural sets of projectors, light receiving lenses and light position detectors in the transverse direction of the gateway or passage, it is made possible to ensure accurate counting and enhance reliability even in the case of simultaneous and parallel passing of plural persons.

Further, by arranging two sets of the projectors, light receiving lenses and light position detectors in the passing direction spacedly from each other, it is possible to judge a moving direction of each passing person (i.e., whether the passing person is incoming or leaving), and thereby count the number of passing persons in plural stages of stature.

What is claimed is:

1. An apparatus for counting the number of persons passing through a location by stature, comprising:

means for projecting a light beam toward the head of a passing person;

means for converging light reflected from a reflective position of the passing person, said converging means including an optical element;

light position detecting means for detecting the reflected light, said light position detecting means having a plurality of light-receiving positions onto which the reflected light is converged by said converging means in accordance with the height of the reflective position, said light positioning detecting means outputting signals which vary in accordance to the reflected light received at said light-receiving positions;

means for setting a plurality threshold values corresponding to height, said setting means including means for storing said plurality of threshold values and means for inputting said threshold values to be stored in said storing means;

means for comparing each of the signals output from said light position detecting means with said threshold values stored in said storing means and for outputting signals that vary in accordance with each of the comparisons; and a plurality of counters for respectively counting the number of passing persons whose height correspond to each of said threshold values based on the comparisons and signals output by said comparing means.

2. An apparatus according to claim 1, further comprising central processing means for controlling the operations of said setting means, said comparing means and said counters.

3. An apparatus according to claim 1, further comprising a plurality of detecting sets that are provided side-by-side along a width of a passageway at said location, each of said detecting sets including one of said projecting means, said converging means, and said light position detecting means.

4. An apparatus according to claim 1, further comprising two detecting sets that are spacedly arranged along a passing direction of a passageway at said location, each of said sets including one of said projecting means, said converging means and said light position detecting means, and means for discriminating a direction of movement of passing persons based upon a light detection sequence of said light position detecting means of said detecting sets.

5. An apparatus for counting the number of persons passing through a location by stature, comprising:

a plurality of detecting sets, each of said sets having a projector that projects a light beam toward the head of a passing person, a lens that converges light reflected from a reflective position of the passing person, and a light position detector that detects the reflected light, said light position detector having a plurality of light detecting elements onto which the reflected light is converged by said lens in accordance with a height of the reflective position, said light position detector outputting signals that are proportional to positions at which the reflected light is received by said light detecting elements;

means for setting a plurality of threshold values corresponding to height, said setting means including a plurality of setting units that store said threshold values and means for inputting said threshold values to be stored in said setting units;

a plurality of comparators, each of which is associated with a respective one of said setting units, that compare the signals output from said light position detector with said threshold values stored in said setting units and output signals based upon the comparisons; and a plurality of counters, each of which is associated with a respective one of said comparators, that respectively count the number of passing persons based upon the comparisons and signals output by said comparators.

6. An apparatus according to claim 5, further comprising a central processing unit for controlling the operations of said comparators, said setting units, said counters and said inputting means.

7. An apparatus according to claim 5, wherein two of said detecting sets are arranged in a passing direction of a passageway at said location.

8. An apparatus according to claim 5, further comprising discriminating means for discriminating a direction of movement of passing persons based upon a light detecting sequence of said light position detectors of said detecting sets.

* * * * *

UNITED STATES PATENT AND TRADEMARK OFFICE

CERTIFICATE OF CORRECTION

PATENT NO. : 5,255,301

DATED : October 19, 1993

INVENTOR(S) : Kiyohisa NAKAMURA et al.

It is certified that error appears in the above-indentified patent and that said Letters Patent is hereby corrected as shown below:

At column 3, line 66, delete "such" before "comparator,".
At column 4, line 26, delete"." after "direction".
At column 5, line 1, insert ---in--- after "value" (first occurrence).

Signed and Sealed this

Fourteenth Day of February, 1995

Bruce Lehman

*Attest:*

BRUCE LEHMAN

*Attesting Officer*

*Commissioner of Patents and Trademarks*